US006758363B2

(12) United States Patent
Stokes

(10) Patent No.: US 6,758,363 B2
(45) Date of Patent: Jul. 6, 2004

(54) PORTABLE BEVERAGE CONTAINER

(75) Inventor: Patrick Stokes, Rochester, MN (US)

(73) Assignee: MugMaster, INC, Rochester, MN (US)

( * ) Notice: Subject to any disclaimer, the term of this patent is extended or adjusted under 35 U.S.C. 154(b) by 108 days.

(21) Appl. No.: 10/236,719

(22) Filed: Sep. 9, 2002

(65) Prior Publication Data

US 2004/0045972 A1 Mar. 11, 2004

(51) Int. Cl.[7] ..... F25B 21/02; F25D 3/08

(52) U.S. Cl. ..... 220/592.15; 62/3.64; 62/457.3; 62/465

(58) Field of Search ..... 62/3.2, 3.64, 3.62, 62/465, 457.8, 457.3; 220/592.05, 592.15

(56) References Cited

U.S. PATENT DOCUMENTS

| | | | | |
|---|---|---|---|---|
| 3,207,461 A | | 9/1965 | Holzwarth et al. | 248/145.3 |
| 3,596,795 A | | 8/1971 | D'Ercoli | 220/97 |
| 4,720,023 A | | 1/1988 | Jeff | 220/412 |
| 4,989,415 A | | 2/1991 | Lombness | 62/372 |
| 5,421,159 A | | 6/1995 | Stokes | 62/3.64 |
| 5,513,496 A | | 5/1996 | Stokes | 62/3.64 |
| 5,531,353 A | | 7/1996 | Ward et al. | 220/729 |
| 5,842,353 A | * | 12/1998 | Kuo-Liang | 62/457.3 |
| 6,032,481 A | * | 3/2000 | Mosby | 62/457.2 |
| 6,422,024 B1 | * | 7/2002 | Foye | 62/3.2 |

* cited by examiner

*Primary Examiner*—William Wayner

(57) ABSTRACT

A portable beverage container that has a body defining a receptacle therein for containing a generally cylindrical cup liner and liquid that can be set inside of the body of the container to hold liquids and the like. The body has a handle for easy grasping and also has a plurality of holes on the bottom perimeter that correspond to raised air passage channels formed between the outside of the generally cylindrical cup liner and the inner wall of the body for increased air flow around the generally cylindrical cup liner. The generally cylindrical cup liner has threads protruding from the top of the cylindrical cup liner to accommodate the inner threading of a top cover that can be twisted onto and off of the top of the cylindrical cup liner. There is a fitted snap-on bottom cap for the bottom of the body as well as a twist-on cap that can form a vacuum seal on the bottom of the body. There is also a combination bottom cap that has both the features of a twist-on cap and a snap-on cap for an additional embodiment.

15 Claims, 4 Drawing Sheets

PORTABLE BEVERAGE CONTAINER

BACKGROUND OF THE INVENTION

1. Field of the Invention

The present invention relates to a portable beverage container.

2. Description of the Related Art

Portable beverage coolers and dispensers are well-known in the related art. These beverage coolers generally have an insulation capability, as well as being easy to hold and easy to drink from. There are also many cup holders and bases that are used with beverage coolers. These are also described in the related art.

U.S. Pat. No. 3,207,461 issued to Holzwarth et al., outlines a holder for cups and more particularly to a one-piece nestable holder for disposable flexible walled cups, generally made of paper, which are commonly used in the dispensing of potable liquids, ice cream and the like.

U.S. Pat. No. 3,596,795 issued to D'Ercoli, outlines thin-walled, plastic cups or containers of the expendable kind for receiving hot or cold beverages, food and the like, and providing a reusable supporting holder for the cups or containers.

U.S. Pat. No. 4,720,023 issued to Jeff, relates to an insulated mug with a detachable flexible retainer that can function as both an insulated holder of a beverage can and as a normal drinking vessel.

U.S. Pat. No. 4,989,415 issued to Lombness, outlines a holder for keeping a can or bottle beverage container cold. The holder includes a cup-shaped base of an inside diameter sufficient to accommodate the outside diameter of the beverage container. A cylindrical upper portion is provided, having both ends open, one end being snap connectable to the base, and an inside diameter which matches the outside diameter of the beverage container.

U.S. Pat. No. 5,421,159 issued to Stokes, outlines an apparatus for chilling the contents of a beverage container, and for dispensing these contents through a faucet formed integrally to the apparatus. A further feature of the apparatus is that the beverage container is opened and fastened to the apparatus, so that the beverage can be dispensed upon demand by operating the faucet.

U.S. Pat. No. 5,513,496 issued to Stokes, also outlines an apparatus for chilling the contents of a beverage container, and for dispensing the contents through a faucet formed integrally to the apparatus. A further feature of the apparatus is that the beverage container is opened and fastened to the apparatus, so that the beverage can be dispensed upon demand by operating the faucet. Alternatively, the beverage container is supported by the apparatus so as to be easily and repeatedly removed from, and returned to the apparatus.

U.S. Pat. No. 5,531,353 issued to Ward et al., outlines the use of a drinking cup device which includes a drinking cup having an open top and a base. A storage portion may be connected and disconnected from the base of the cup portion. A cylindrical shoulder on the cup portion base mates with an open top on the storage portion. A removable lid has an upper side and a lower side. The upper side of the lid receives either the cup portion base or the storage portion.

Although each of the outlined patents describe a useful invention, the invention outlined in U.S. Pat. No. 5,513,496 issued to Stokes, is particularly useful. However, the beverage container is always used with the cooling shroud, which can be cumbersome and bulky. What would be valuable, would be if the beverage container from the Stokes patent, could be used separately from the cooling shroud, as a separate portable beverage container apart from the cooling shroud.

None of the above inventions and patents, taken either singularly or in combination, is seen to describe the instant invention as claimed. Thus an improved portable beverage cooler and dispenser solving the aforementioned problems is desired.

SUMMARY OF THE INVENTION

The invention is a portable beverage container that has a body defining a receptacle therein for containing a generally cylindrical cup liner and liquid that can be set inside of the body of the container to hold liquids and the like. The body has a handle for easy grasping and also has a plurality of holes on the bottom perimeter that correspond to raised air passage channels formed between the outside of the generally cylindrical cup liner and the inner wall of the body for increased air flow around the generally cylindrical cup liner. The generally cylindrical cup liner has threads protruding from the top of the cylindrical cup liner to accommodate the inner threading of a top cover that can be twisted onto and off of the top of the cylindrical cup liner. There is a fitted snap-on bottom cap for the bottom of the body and as well as a twist-on cap that can form a vacuum seal on the bottom of the body. There is also a combination bottom cap that has both the features of a twist-on cap and a snap-on cap for an additional embodiment.

Accordingly, it is a principal object of the invention to provide an portable beverage container used in the Stokes patent (U.S. Pat. No. 5,513,496).

It is another object of the invention to provide a portable beverage container used in the Stokes patent (U.S. Pat. No. 5,513,496) that can be modified to work as a stand-alone portable beverage container separate from the cooling shroud described in the Stokes patent.

It is a further object of the invention to provide a portable beverage container used in the Stokes patent that protects the drainage holes in the container from accumulating debris while being washed in a dishwasher.

Still another object of the invention is to provide a beverage container used in the Stokes patent that has improved cold or warm air circulation within the portable beverage container.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an improved portable beverage container 10. More specifically, the improved beverage container 10 is an improvement of the beverage container used in U.S. Pat. No. 5,513,496 issued to Stokes. The improved portable beverage container 10 has been modified to be a stand-alone portable beverage container that is also easier to use in a dishwasher, without having to worry about any debris being formed on the bottom of the improved portable beverage container 10. The improved portable beverage container 10 also has improved air circulation around the generally cylindrical cup liner 30, as is discussed later in this application.

Figure 1:
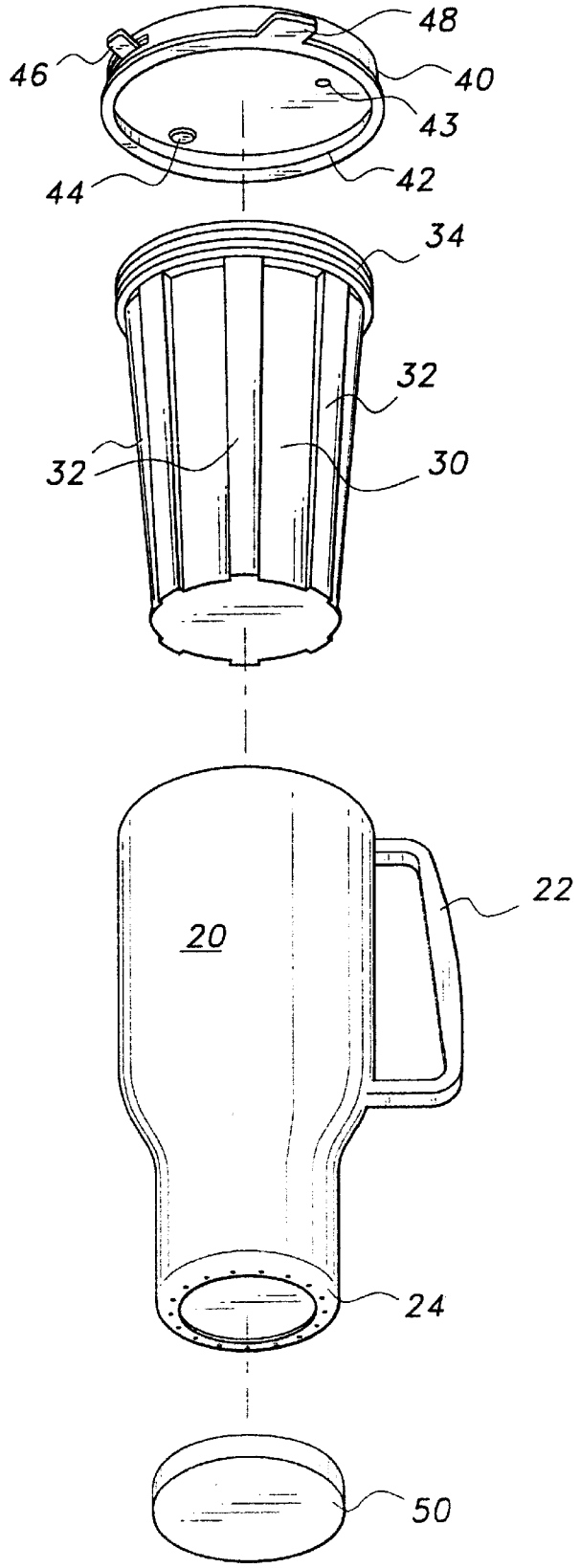
FIG. 1 is an exploded front perspective view of the first embodiment of a portable beverage container according to the present invention.

The improved portable beverage container 10 is outlined on FIG. 1 and comprises, a body 20 defining a receptacle therein for containing a generally cylindrical cup liner 30 and liquid (not shown) that can be set inside of the body 20 of the container 10 to hold liquids and the like, the body 20 having a handle 22 for easy grasping, the body 20 also having a plurality of holes 24 on the bottom perimeter of the body 20 that correspond to raised air passage channels 32 formed between the outside of the generally cylindrical cup liner 30 and the inner wall of the body 20 for increased air flow around the generally cylindrical cup liner 30. The generally cylindrical cup liner 30 has threads 34 protruding from the top of the cylindrical cup liner 30 to accommodate the inner threading 42 of a top cover 40 that can be twisted onto and off of the top of the cylindrical cup liner 30. A fitted snap-on bottom cap 50 that snaps-on to the bottom of the body 20 is also provided, forming a vacuum seal over the plurality of holes 24 on the bottom of the body 20. This snap-on bottom cap 50 is a new feature of the improved portable beverage container 10 in comparison to the beverage container described in the original design and function from U.S. Pat. No. 5,513,496 issued to Stokes. The snap-on bottom cap 50 is also provided an outside surface slip resistant material (not shown) for easy grasping.

The improved portable beverage container 10 utilizes the top cover 40 which has a dispenser aperture 44 and tab 46 to pour and distribute liquid from the inside of the cylindrical cup liner 30. There is also a ventilation hole 43 provided on the top cover. A second tab 48 can also be used to "pop open" the top cover 40 by hand as well.

Figure 2:
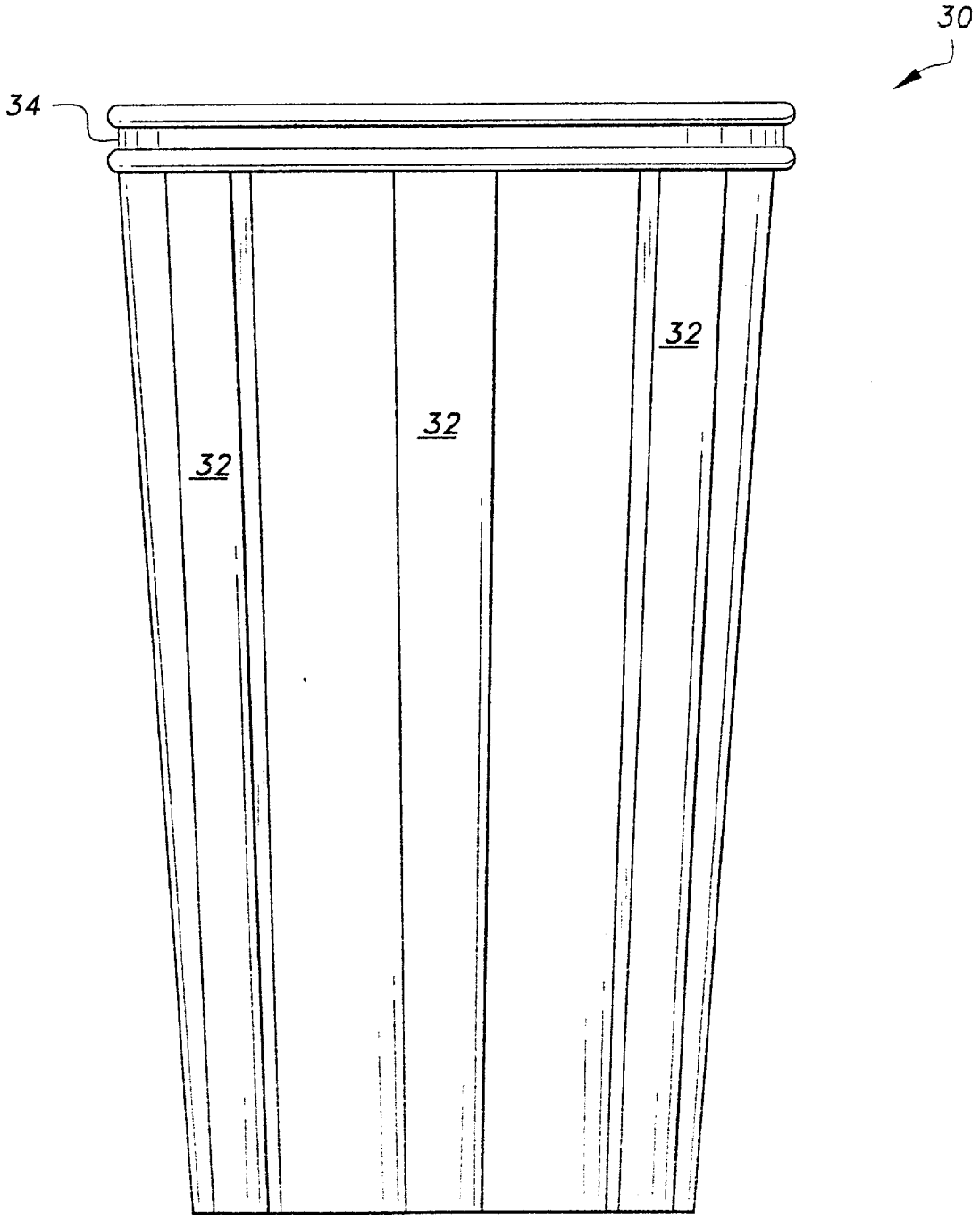
FIG. 2 is a front perspective view of a portable beverage container.

FIG. 2 shows a closer view of the generally cylindrical cup liner 30. There are a minimum of 3 raised air passage channels 32, which make contact with the inner wall of the body 20, which form air passage and circulation channels (not shown) that surround the generally cylindrical cup liner 30. Air can flow from the plurality of holes 24 on the bottom of the body 20 to allow circulating air. If a snap-on bottom cap 50 is applied, then air is blocked from the outside, and the air circulating is caught in a closed system around the improved portable beverage container 10.

Figure 3:
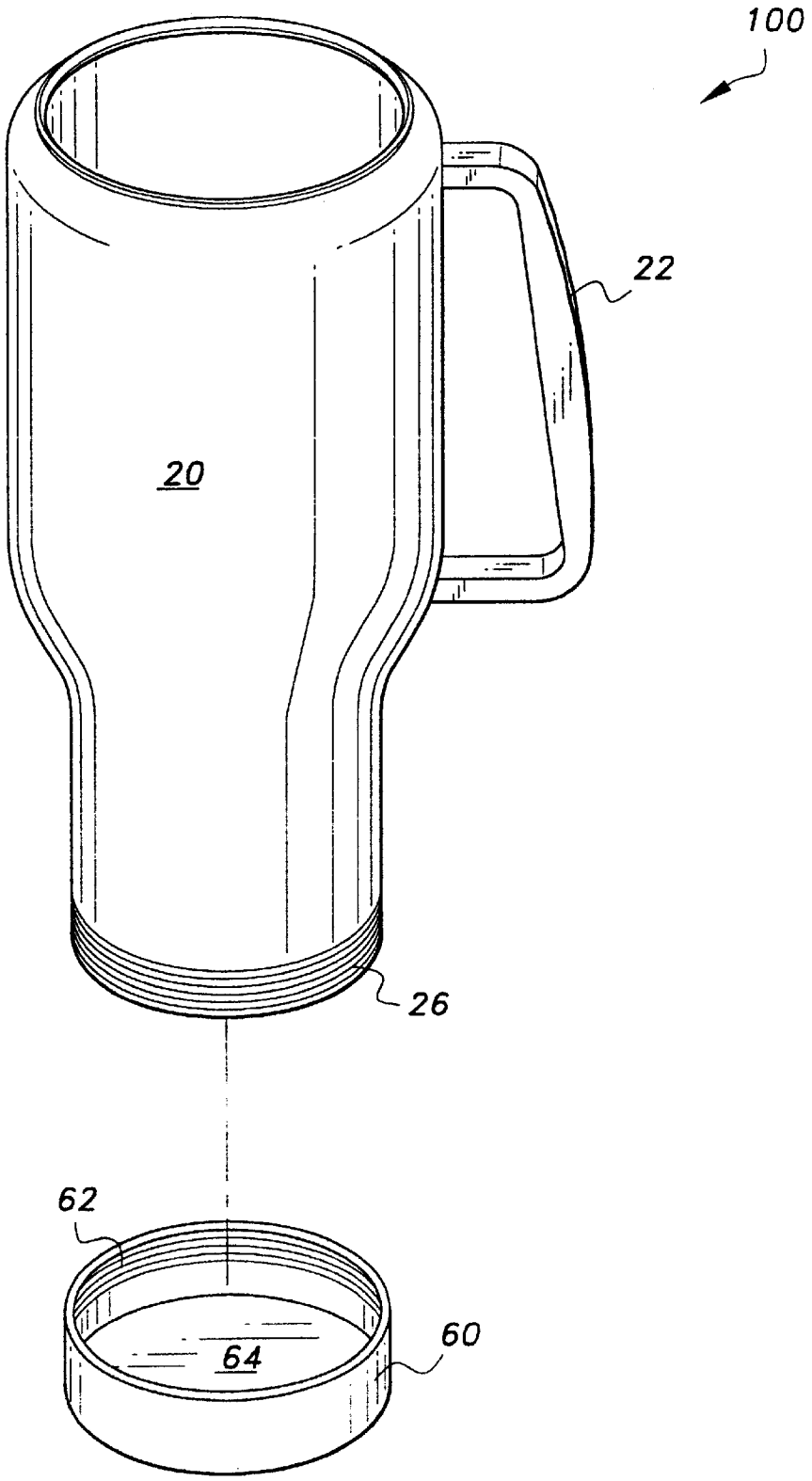
FIG. 3 is an exploded front perspective view of a second embodiment of a portable beverage container.

FIG. 3 illustrates the second embodiment of the improved portable beverage container 100. Many individual components from the first embodiment 10 are identical to the second embodiment 100, such as a body 20 defining a receptacle therein for containing a generally cylindrical cup liner 30 and liquid that can be set inside of the body 20 of the container 10 to hold liquids and the like, the body having a handle 22 for easy handling. The body 20 also has a plurality of holes 24 on the bottom perimeter of the body 20, that correspond to raised air passage channels 32 formed between the outside of the generally cylindrical cup liner 30 and the inner wall of the body 20 for increased air flow around the generally cylindrical cup liner 30.

The second embodiment of the improved portable beverage container 100, also has a generally cylindrical cup liner 30 having threads protruding 34 from the top of the generally cylindrical cup liner 30 to accommodate the inner threading of a top cover 40 that can be twisted onto and off of the top of the generally cylindrical cup liner 30. The second embodiment of the portable beverage container 100, also has a top cover 40 that has a dispenser aperture 44 to pour and distribute liquid from the inside of the generally cylindrical cup liner 30. The improved portable beverage container 10, utilizes the top cover 40 which has a dispenser aperture 44 and tab 46 to pour and distribute liquid from the inside of the cylindrical cup liner 30. A second tab 48 can also be used to "pop open" the top cover 40 by hand as well.

There are also some differences between the first embodiment of the invention 10 and the second embodiment of the invention 100. Instead of a snap-on bottom cap 50, the second embodiment of the invention 100 utilizes a twist-on bottom cap 60 for the bottom of the body 20 that can be twisted onto and off of the bottom of the body 20. The twist-on bottom cap 60 also forms a vacuum seal on the bottom of the body 20 with the twist-on bottom cap 60 and is provided with slip-resistant material (not shown) on its outside surface. The inside bottom 64 of the twist-on bottom cap 60 can press right-up against the plurality of holes (not visible on FIG. 3) to form a vacuum seal. The twist-on bottom cap 60 also has interlocking threads 62 on the inside of the twist-on bottom cap 60 to mate with the threads 26 provided on the outside of the body 20. These threads are arranged to serve as a stopping mechanism after only a few turns clockwise or counter-clockwise.

Figure 4:
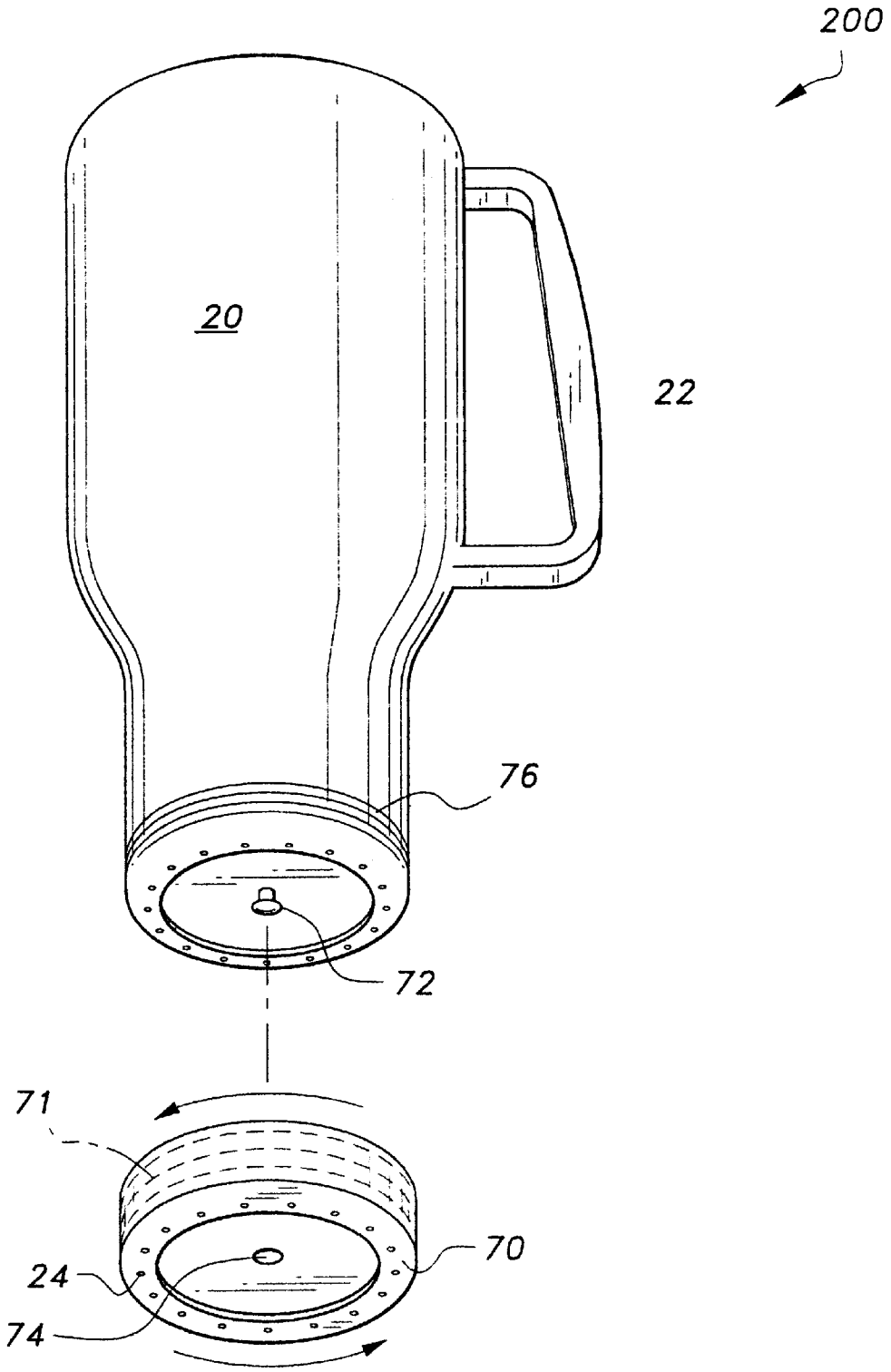
FIG. 4 is an exploded front perspective view of the third embodiment of a portable beverage container.

There is also a third embodiment 200 of the invention, which is depicted in FIG. 4. This embodiment utilizes a combination twist-on and fitted snap-on bottom cap 70 for the bottom of the body 20 that can be twisted onto and off of or snapped onto or off of the bottom of the body 20, forming a vacuum seal on the bottom of the body 20. In other words, this embodiment can be screwed on and off or snapped on and off, incorporating the features of the first embodiment 10 and the second embodiment 100. The third embodiment 200 has a raised button 72 and corresponding aperture 74 on the combination bottom cap 70. There are also the same inner threads 71 on the combination bottom cap 70 and outer threads 76 on the outer body 20. These threads are also arranged to serve as a stopping mechanism after only a few turns clockwise or counter-clockwise. Slip-resistant material is also provided on the outside surface of the combination bottom cap 70.

All of the components of the three embodiments of the improved portable beverage container 10,100,200 are dishwasher safe and are made of aluminum, stainless steel or sturdy thermoplastic material. Both embodiments 10,100 can be also easily manipulated by the user by hand and can also operate with the device described in U.S. Pat. No. 5,513,496 issued to Stokes.

It is to be understood that the present invention is not limited to the embodiments described above, but encompasses any and all embodiments within the scope of the following claims.

I claim:

1. A portable beverage container, comprising:

a body defining a receptacle therein for containing a generally cylindrical cup liner and liquid that can be set inside of the body of the container to hold liquids and the like, said body having a handle for easy grasping;

said body also having a plurality of holes on the bottom perimeter that correspond to raised air passage channels formed between the outside of the generally cylindrical cup liner and the inner wall of the body for increased air flow around the generally cylindrical cup liner;

said generally cylindrical cup liner having threads protruding from the top of the cylindrical cup liner to accommodate the inner threading of a top cover that can be twisted onto and off of the top of the cylindrical cup liner; and a fitted snap-on, slip-resistant bottom cap for the bottom of the body, forming a vacuum seal on the bottom of the body.

2. The portable beverage container, according to claim 1, wherein the top cover has a dispenser aperture to pour and distribute liquid from the inside of the cylindrical cup liner.

3. The portable beverage container, according to claim 1, wherein the portable beverage container is made of aluminum.

4. The portable beverage container, according to claim 1, wherein the portable beverage container is made of stainless steel.

5. The portable beverage container, according to claim 1, wherein the portable beverage container is made of plastic.

6. A portable beverage container, comprising:

a body defining a receptacle therein for containing a generally cylindrical cup liner and liquid that can be set inside of the body of the container to hold liquids and the like, said body having a handle for easy handling;

said body also having a plurality of holes on the bottom perimeter that correspond to raised air passage channels formed between the outside of the generally cylindrical cup liner and the inner wall of the body for increased air flow around the generally cylindrical cup liner;

said generally cylindrical cup liner having threads protruding from the top of the cylindrical cup liner to accommodate the inner threading of a top cover that can be twisted onto and off of the top of the cylindrical cup liner; and a twist-on, slip-resistant bottom cap for the bottom of the body that can be twisted onto and off of the bottom of the body, forming a vacuum seal on the bottom of the body with the twist-on cap.

7. The portable beverage container, according to claim 6, wherein the top cover has a dispenser aperture to pour and distribute liquid from the inside of the cylindrical cup liner.

8. The portable beverage container, according to claim 6, wherein the portable beverage container is made of aluminum.

9. The portable beverage container, according to claim 6, wherein the portable beverage container is made of stainless steel.

10. The portable beverage container, according to claim 6, wherein the portable beverage container is made of plastic.

11. A portable beverage container, comprising:

a body defining a receptacle therein for containing a generally cylindrical cup liner and liquid that can be set inside of the body of the container to hold liquids and the like, said body having a handle for easy handling;

said body also having a plurality of holes on the bottom perimeter that correspond to raised air passage channels formed between the outside of the generally cylindrical cup liner and the inner wall of the body for increased air flow around the generally cylindrical cup liner;

said generally cylindrical cup liner having threads protruding from the top of the cylindrical cup liner to accommodate the inner threading of a top cover that can be twisted onto and off of the top of the cylindrical cup liner; and a combination slip-resistant twist-on and fitted snap-on bottom cap for the bottom of the body that can be twisted onto and off of or snapped onto or off of the bottom of the body, forming a vacuum seal on the bottom of the body.

12. The portable beverage container, according to claim 11, wherein the top cover has a dispenser aperture to pour and distribute liquid from the inside of the cylindrical cup liner.

13. The portable beverage container, according to claim 11, wherein the portable beverage container is made of aluminum.

14. The portable beverage container, according to claim 11, wherein the portable beverage container is made of stainless steel.

15. The portable beverage container, according to claim 11, wherein the portable beverage container is made of plastic.

* * * * *